US007834262B2

(12) United States Patent
Tamura

(10) Patent No.: US 7,834,262 B2
(45) Date of Patent: Nov. 16, 2010

(54) ELECTRONIC KEYBOARD INSTRUMENT

(75) Inventor: Eiichi Tamura, Hamamatsu (JP)

(73) Assignee: Kabushiki Kaisha Kawai Gakki Seisakusho, Shizuoka-ken ( * ) Notice: Subject to any disclaimer, the term of this patent is extended or adjusted under 35 U.S.C. 154(b) by 152 days.

(21) Appl. No.: 12/329,140

(22) Filed: Dec. 5, 2008

(65) Prior Publication Data

US 2009/0145286 A1 Jun. 11, 2009

(30) Foreign Application Priority Data

Dec. 7, 2007 (JP) ..... 2007-316766

(51) Int. Cl.
*G10H 1/34* (2006.01)
*G10H 1/28* (2006.01)

(52) U.S. Cl. ..... 84/745; 84/613; 84/637; 84/638; 84/669; 84/719; 84/720; 84/744

(58) Field of Classification Search ..... None
See application file for complete search history.

(56) References Cited

U.S. PATENT DOCUMENTS 6,051,771 A * 4/2000 Iizuka ..... 84/622
7,091,410 B2 * 8/2006 Ito et al. ..... 84/638
7,432,436 B2 * 10/2008 Ito et al. ..... 84/638

FOREIGN PATENT DOCUMENTS

JP 3183385 7/1997

* cited by examiner

*Primary Examiner*—Marlon T Fletcher
(74) *Attorney, Agent, or Firm*—Crowell & Moring LLP

(57) ABSTRACT

An electronic keyboard instrument which is capable of easily carrying out an arpeggio performance rich in variety by a simple operation on a touch strip. The electronic keyboard instrument has a belt-like touch strip on which a player slides his finger while touching it to carry out an arpeggio performance. A CPU causes musical tones of respective pitch names included in respective designated component pitch names to be sounded, in a predetermined arpeggio pattern having a predetermined sounding order, according to detected touch positions on the touch strip, for the arpeggio performance. A musical tone generating circuit for generating musical tones for the arpeggio performance is switched between first and second tone generator circuits for generating musical tones based on key-on information detected on swingable keys and a third tone generator circuit dedicated to generation of musical tones for the arpeggio performance.

2 Claims, 8 Drawing Sheets

FIG. 7
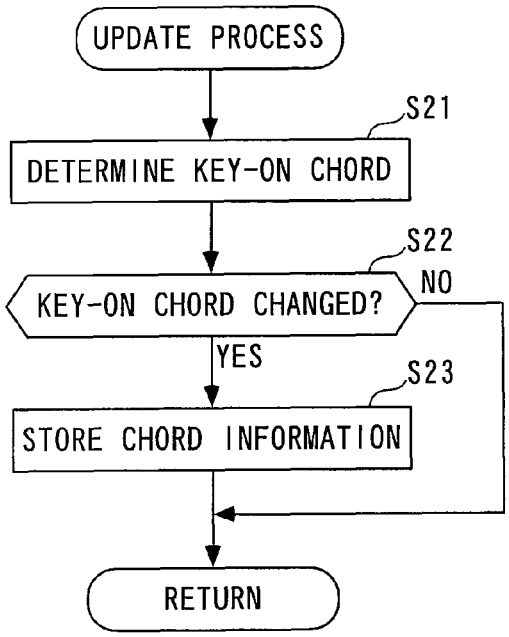
FIG. 8A Normal
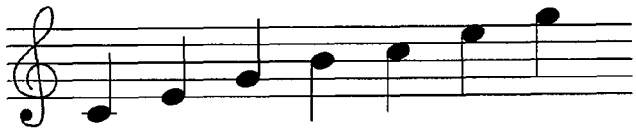
FIG. 8B Skip
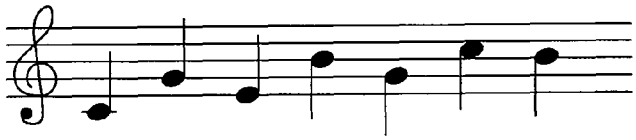

FIG. 9A

COMPONENT PITCH NAME COUNT BUFFER 4

| No | PITCH NAME |
|---|---|
| 0 | C |
| 1 | E |
| 2 | G |
| 3 | B |
| 4 | - |
| 5 | - |
| 6 | - |
| 7 | - |
| 8 | - |
| 9 | - |
| 10 | - |
| 11 | - |

FIG. 9B

COMPONENT PITCH NAME COUNT BUFFER 0

| No | PITCH NAME |
|---|---|
| 0 | C |
| 1 | C# |
| 2 | D |
| 3 | D# |
| 4 | E |
| 5 | F |
| 6 | F# |
| 7 | G |
| 8 | G# |
| 9 | A |
| 10 | A# |
| 11 | B |

ELECTRONIC KEYBOARD INSTRUMENT

BACKGROUND OF THE INVENTION

1. Field of the Invention

The present invention relates to an electronic keyboard instrument provided with a touch strip on which a player slides his/her finger while touching the touch strip.

2. Description of the Related Art

As a conventional electronic musical instrument, there has been known one disclosed in Publication of Japanese Patent No. 3183385. This electronic musical instrument includes a touch panel, a CPU, a tone generator circuit, and an audio system. The touch panel is formed into a sheet shape, and a keyboard comprised of a plurality of keys is drawn on an upper surface of the touch panel. The touch panel is electrically connected to the CPU, and outputs to the CPU a signal corresponding to a touch position at which a player touches the key board. The CPU calculates the key number of a touched key based on the signal, and converts the key number into a pitch value, followed by outputting the same to the tone generator circuit. The tone generator circuit generates a musical tone signal based on the pitch value and outputs the same to the audio system. The audio system reproduces the musical tone signal to thereby output a musical tone of a pitch corresponding to the pitch value.

However, the conventional electronic musical instrument described above is only configured to generate musical tones corresponding to key numbers associated with respective touch positions on the touch panel. For this reason, in the case of carrying out an arpeggio performance rich in variety, it is required to operate the touch panel properly in accordance with the arpeggio performance, which makes the operation complicated.

SUMMARY OF THE INVENTION

It is an object of the present invention to provide an electronic musical instrument which is capable of easily carrying out an arpeggio performance rich in variety by a simple operation on a touch strip.

To attain the above object, the present invention provides an electronic keyboard instrument comprising a touch strip in the form of a belt on which a keyboard having a plurality of keys arranged in a left-right direction thereof is displayed and a player slides a player's finger while touching the touch strip, so as to carry out an arpeggio performance, touch position-detecting means for detecting touch positions on the touch strip at which the player's finger touches the touch strip, component pitch name-designating means for designating a plurality of component pitch names to be sounded in the arpeggio performance, arpeggio performance means for sounding musical tones of respective pitch names included in the respective designated component pitch names, in a predetermined arpeggio pattern having a predetermined sounding order, according to the touch positions detected when the player slides his/her finger on the touch strip while touching the touch strip, to thereby carry out the arpeggio performance using the component pitch names, a first musical tone-generating circuit dedicated to generation of musical tones for the arpeggio performance, a plurality of swingable keys, key-on information-detecting means for detecting key-on information on each of the keys, a second musical tone-generating circuit for generating musical tones based on the key-on information detected by the key-on information-detecting means, and switching means for switching a musical tone generating circuit for use in generation of musical tones for the arpeggio performance between the first musical tone-generating circuit and the second musical tone-generating circuit.

With the arrangement of the electronic keyboard instrument according to the present invention, when the player touches the surface of the touch strip in the form of a belt having the keyboard displayed thereon and slides the player's finger on the touch strip, touch positions on the touch strip touched by the player's finger are detected, whereby musical tones of respective pitch names included in the component pitch names designated by the component pitch name-designating means are sounded in an arpeggio pattern having a predetermined sounding order, according to the detected touch positions. Thus, simply by sliding the finger on the touch strip, it is possible to carry out an arpeggio performance.

Further, when a plurality of swingable keys are depressed, key-on information on each of the depressed keys is detected, and musical tones are generated by the second musical tone-generating circuit based on the key-on information. The musical tone generating circuit for use in generation of musical tones for the arpeggio performance can be switched between the first musical tone-generating circuit dedicated to arpeggio performance and the second musical tone-generating circuit originally for use in generation of musical tones based on the key-on information. Therefore, when the second musical tone-generating circuit is selected, sounding of musical tones using functions of the second musical tone-generating circuit is made possible. By thus utilizing the existing second musical tone-generating circuit for arpeggio performance which is carried out using the touch strip, an arpeggio performance rich in variety can be realized.

Preferably, the electronic keyboard instrument further comprises arpeggio pattern storage means for storing, as the predetermined arpeggio pattern, a plurality of arpeggio patterns having respective sounding orders different from each other, and including at least one skip pattern, and arpeggio pattern-selecting means for selecting one arpeggio pattern from the stored arpeggio patterns.

With this arrangement, when one arpeggio pattern is selected from the stored arpeggio patterns, an arpeggio performance is carried out according to the selected arpeggio pattern. Further, since the stored arpeggio patterns include at least one skip pattern, an arpeggio performance can be carried out in the skip pattern as well as in a normal pattern, which makes the arpeggio performance rich in variety.

The above and other objects, features, and advantages of the present invention will become more apparent from the following detailed description taken in conjunction with the accompanying drawings.

BRIEF DESCRIPTION OF THE DRAWINGS

FIG. 7 is a flowchart of an update process for updating chord information

FIGS. 8A and 8B are views useful in explaining examples of operation by the touch strip;

FIGS. 9A and 9B are diagrams useful in explaining the relationship between component pitch name buffers corresponding to a component pitch name count and pitch names.

DETAILED DESCRIPTION OF PREFERRED EMBODIMENTS

Figure 1:
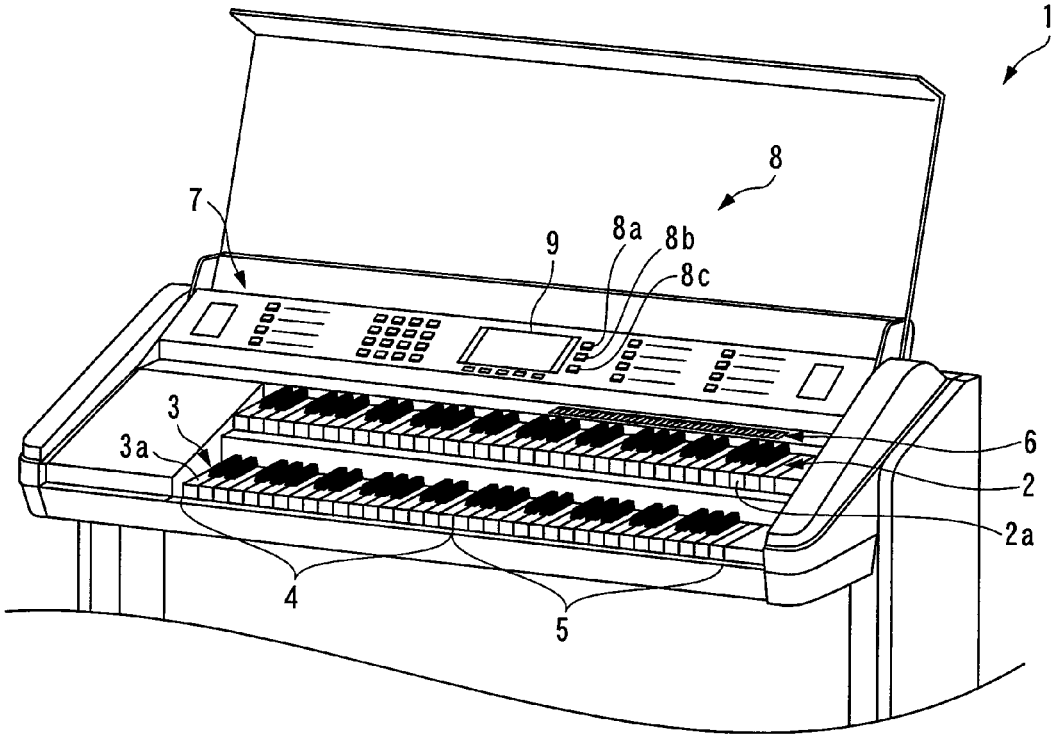
FIG. 1 is a view of a main part of an electronic organ according to an embodiment of the present invention.

The invention will now be described in detail with reference to drawings showing a preferred embodiment thereof. FIG. 1 shows a main part of an electronic organ 1 according to the embodiment of the present invention. In the following description, a player's side of the electronic organ 1 will be referred to as "front", and a remote side from the player's side as "rear". Further, a left side as viewed from the player's side will be referred to as "left", and a right side as "right".

Figure 4:
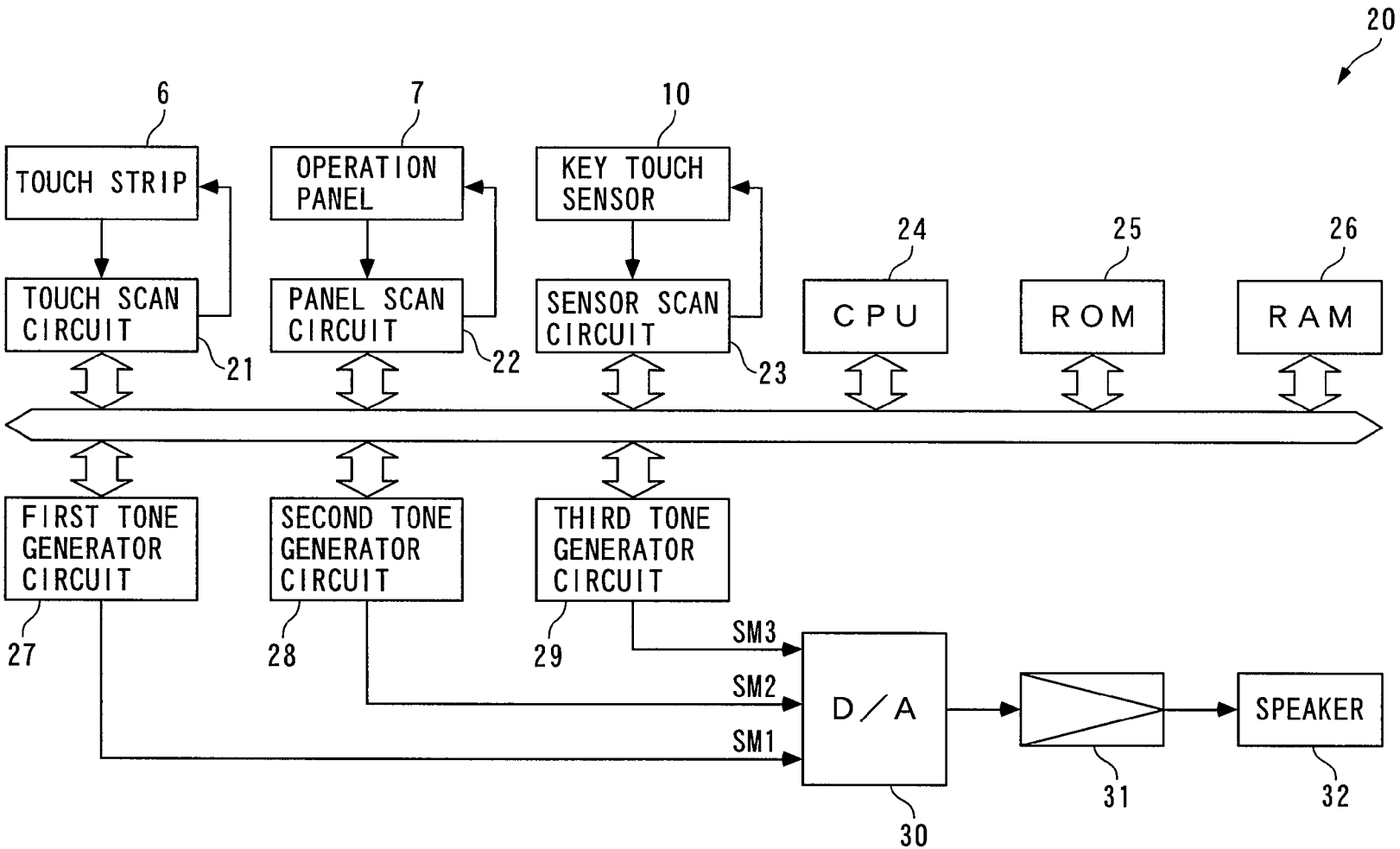
FIG. 4 is a block diagram of a musical tone generator.

The electronic organ 1 is comprised of an upper keyboard 2, a lower keyboard 3, a touch strip 6, an operation panel 7, and a musical tone generator 20 (see FIG. 4).

The upper keyboard 2 has a plurality of (e.g. sixty-one) vertically swingable keys 2*a*. Similarly to the upper keyboard 2, the lower keyboard 3 has a plurality of (e.g. sixty-one) vertically swingable keys 3*a*, and is comprised of a left lower keyboard 4 formed by a left half of the keys 3*a* and a right lower keyboard 5 formed by a right half of the keys 3*a*. It should be noted that the left lower keyboard 4 is not only used for normal performance together with the right lower keyboard 5, but also used, by switching its setting, to designate component pitch names which form an arpeggio chord during an arpeggio performance, described hereinafter, carried out using the touch strip 6. Each of the keys 2*a* and 3*a* is provided with a key touch sensor 10 (see FIG. 4). The key touch sensor 10 is implemented e.g. by an optical sensor, and detects a key-on state of an associated one of the keys 2*a* and 3*a* and outputs a signal indicative of the sensed state to the musical tone generator 20.

Figure 2:
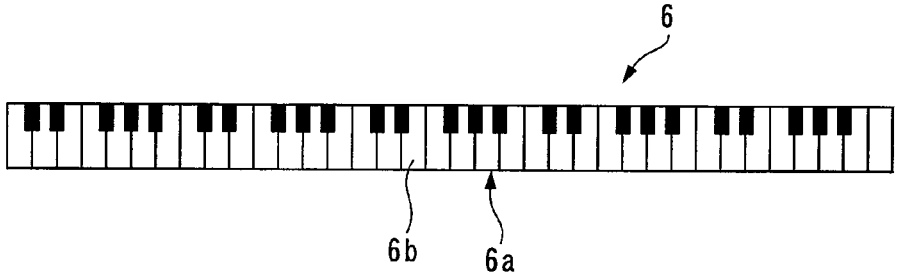
FIG. 2 is a view of a touch strip.

The touch strip 6 is formed by a belt-like piezoelectric sheet extending in the left-right direction, and is disposed at a location immediately rearward of the upper keyboard 2. As shown in FIG. 2, on the touch strip 6, there is displayed a keyboard 6*a* comprised of a plurality of (e.g. sixty-one) keys 6*b* arranged in the left-right direction. The touch strip 6 is configured to generate a voltage when an external force acts on the touch strip 6 from above. Voltages to be generated are set to respective values different from each other in the left-right direction such that generated voltage increases e.g. from the lowest pitch (left end in FIG. 2) toward a higher-pitch side. The touch strip 6 outputs a detection signal indicative of the value of a generated voltage to the musical tone generator 20. The player carries out an arpeggio performance by operating the touch strip 6 with his/her finger (i.e. by sliding the finger while touching the touch strip 6).

The operation panel 7 is provided with operation switches 8 including a monophonic switch 8*a*, a harmony selection switch 8*b*, and a grace note selection switch 8*c*, and a display section 9.

The monophonic switch 8*a* is turned on so as to add a monophonic effect to a musical tone, and a signal indicative of the on/off state of the monophonic switch 8*a* is output to the musical tone generator 20. The harmony selection switch 8*b* is operated so as to select a pattern of a harmony effect (hereinafter referred to as a harmony pattern) to be added to a musical tone. By operating the harmony selection switch 8*b*, a harmony signal indicative of a harmony pattern selected from ones displayed on the display section 9 is output to the musical tone generator 20. The grace note selection switch 8*c* is operated so as to select a grace note effect to be added to a musical tone. By operating the grace note selection switch 8*c*, a grace note signal indicative of a grace note pattern selected from ones displayed on the display section 9 is output to the musical tone generator 20.

The display section 9 is formed e.g. by a touch panel. The display section 9 displays not only the settings of the above-mentioned operation switches 8, but also information concerning sound sources, arpeggio patterns, and tone colors. The display screen of the display section 9 can be switched from one screen to another by touching (operating) the display section 9.

As shown in FIG. 4, the musical tone generator 20 is comprised of a touch scan circuit 21, a panel scan circuit 22, a sensor scan circuit 23, a CPU 24, a ROM 25, a RAM 26, a first tone generator circuit 27, a second tone generator circuit 28, a third tone generator circuit 29, a D/A converter 30, a power amplifier 31, and a speaker 32.

The touch scan circuit 21 detects touch information on the touch strip 6 and touch position information including a touch position number indicative of a touch position associated with a touched one of the keys 6*b* on the touch strip 6, based on a detection signal from the touch strip 6, and outputs signals indicative of the information to the CPU 24.

The panel scan circuit 22 outputs signals from the operation switches 8 and the display section 9 to the CPU 24. Further, the panel scan circuit 22 outputs signals indicative of sound source information, tone color information, arpeggio pattern information, etc. to the display section 9 according to command signals from the CPU 24.

The sensor scan circuit 23 detects on/off information on the keys 2*a* and 3*a* and key number information identifying ones of the keys 2*a* and 3*a* turned on or off, based on the detection signals from the key touch sensors 10, and outputs the on/off information and the key number information as key-on information on the keys 2*a* and 3*a* to the CPU 24.

The ROM 25 stores the arpeggio patterns for use in arpeggio performance in addition to control programs to be executed by the CPU 24. The arpeggio patterns include a normal pattern and a skip pattern. In the normal pattern, musical tones of respective component pitch names forming a chord are sequentially sounded in order of pitch (see FIG. 8A). In the skip pattern, musical tones of respective component pitch names forming a chord are sounded in a skipping manner in respect of transition in pitch, regardless of the order of their pitches (see FIG. 8B). The normal pattern and the skip pattern are set in advance as a pattern map (see FIG. 10). In this map, there are set component pitch names forming a chord and corresponding to voltage values from the touch strip 6, and pitches, for each number of component pitch names forming each chord.

The RAM 26 temporarily stores status information indicative of an operational status of the electronic organ 1 and chord information, described hereinafter, including information on component pitch names of a key-on chord designated when keys 3*a* on the left lower keyboard 4 are depressed. Further, the RAM 26 is used as a work area for the CPU 24.

Figure 5:
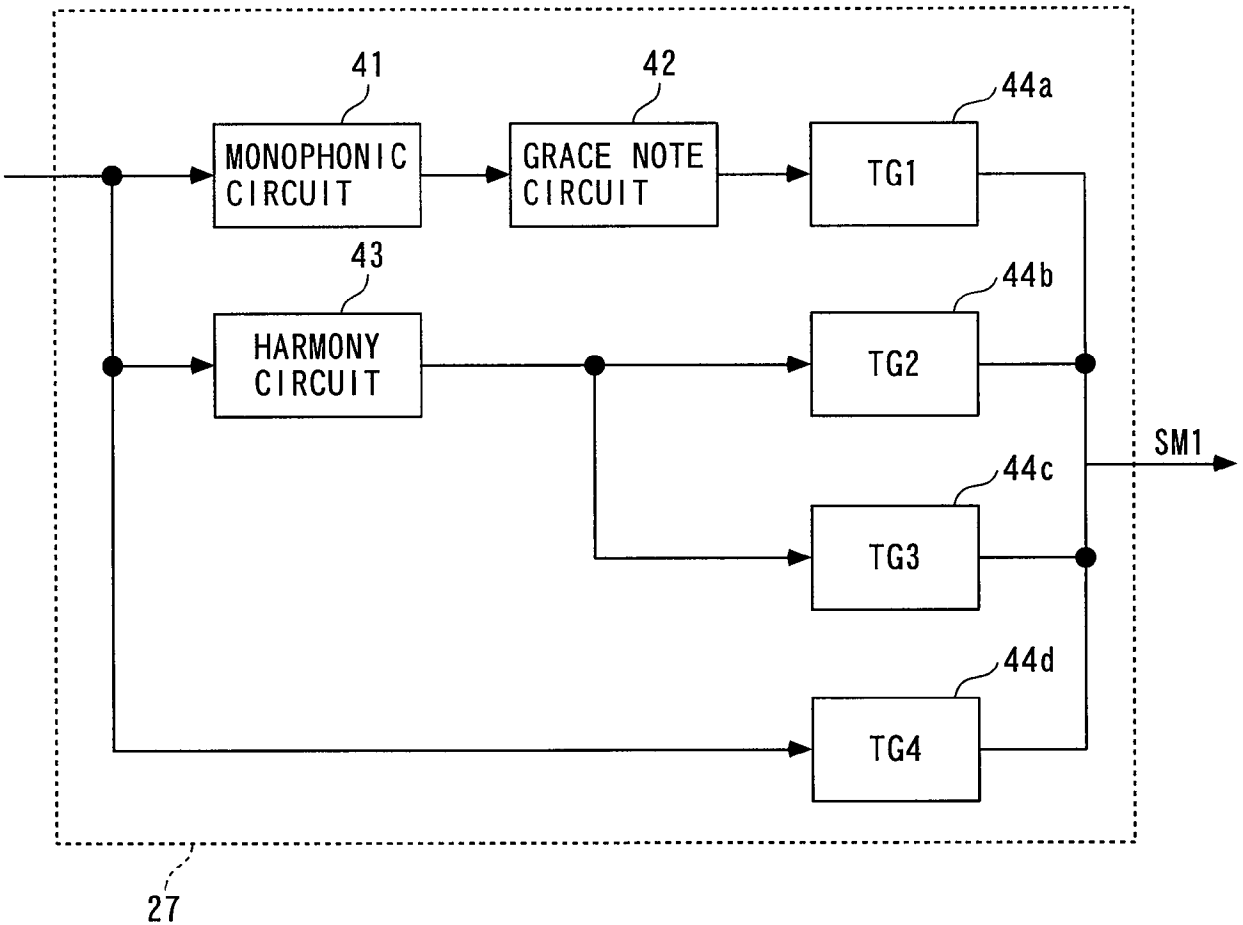
FIG. 5 is a block diagram of a first tone generator circuit.

The first tone generator circuit 27 is provided to generate a first musical tone signal SM1 when each key 2*a* of the upper keyboard 2 is depressed. As shown in FIG. 5, the first tone generator circuit 27 is comprised of a monophonic circuit 41, a grace note circuit 42, a harmony circuit 43, and first to fourth tone color circuits (shown as TG1 to TG4 in FIG. 5) 44*a* to 44*d*. It should be noted that the first tone generator circuit 27 is also used for generation of musical tones for an arpeggio performance, as described hereinafter.

The monophonic circuit 41 is provided to add a predetermined monophonic effect to an original tone signal output from the CPU 24. The monophonic circuit 41 generates a highest-frequency musical tone signal associated with the pitch name of a depressed key 2*a*, according to a control signal from the CPU 24, and adds the musical tone signal to the original tone signal, whereby the monophonic effect is added to an associated musical tone.

The grace note circuit 42 is provided to add a predetermined grace note effect to an original tone signal output from the monophonic circuit 41. The grace note circuit 42 generates a predetermined grace note signal according to a control signal from the CPU 24, and adds the grace note signal to the original tone signal, whereby the grace note effect is added to an associated musical tone.

The harmony circuit 43 is provided to add a predetermined harmony effect to an original tone signal output from the CPU 24. The harmony circuit 43 generates a predetermined harmony signal according to a control signal from the CPU 24, and adds the harmony signal to the original tone signal, whereby the harmony effect is added to an associated musical tone.

Each of the first to fourth tone color circuits 44*a* to 44*d* is provided to generate a tone color signal associated with a selected tone color according to a control signal from the CPU 24, and adds the tone color signal to an original tone signal. Specifically, the first tone color circuit 44*a* adds a predetermined tone color signal to an original tone signal from the grace note circuit 42. Each of the second and third tone color circuits 44*b* and 44*c* adds a predetermined tone color signal to an original tone signal from the harmony circuit 43. The fourth tone color circuit 44*d* adds a predetermined tone color signal to an original tone signal from the CPU 24. Thus, a musical tone having a predetermined tone color is generated. The original tone signals output from the respective first to fourth tone color circuits 44*a* to 44*d* are synthesized, whereby the first musical tone signal SM1 is generated and output from the first tone generator circuit 27 to the D/A converter 30.

The second tone generator circuit 28 is provided to generate a second musical tone signal SM2 when each key 3*a* of the lower keyboard 3 is depressed. The second tone generator circuit 28 is identical in configuration to the first tone generator circuit 27, and has a monophonic circuit, a grace note circuit, a harmony circuit, and four tone color circuits (none of which are shown). The second tone generator circuit 28 also adds a monophonic effect, a harmony effect, a grace note effect, and a tone color effect to respective original tone signals according to control signals from the CPU 24. The second musical tone signal SM2 generated as above is output to the D/A converter 30. It should be noted that the second tone generator circuit 28 is also used for generation of musical tones for an arpeggio performance, as described hereinafter.

The third tone generator circuit 29 is dedicated to generation of a third musical tone signal SM3 performed when the touch strip 6 is operated. The third tone generator circuit 29 is formed by a single tone color circuit. The third tone generator circuit 29 adds a predetermined tone color signal to an original tone signal according to a control signal from the CPU 24 to thereby generate the third musical tone signal SM3, and output the generated third musical tone signal SM3 to the D/A converter 30.

The D/A converter 30 converts the first to third musical tone signals SM1 to SM3 as digital signals into an analog signal. The amplifier 31 amplifies the resulting analog signal by a predetermined gain, and the speaker 32 reproduces the amplified analog signal such that it is output as a musical tone.

The CPU 24 performs sounding control according to signals from the above-described respective scan circuits 21 to 23. Specifically, the CPU 24 determines which of the keys 2*a* and 3*a* of the upper and lower keyboards 2 and 3 is/are operated for sounding, based on key-on information from the sensor scan circuit 23, to generate original tone signals corresponding to pitch names associated with the key numbers of the respective keys 2*a* and 3*a*, and outputs the generated original tone signals to the first tone generator circuit 27 and the second tone generator circuit 28. With this configuration, when each of the keys 2*a* and 3*a* of the upper and lower keyboards 2 and 3 is depressed, an associated musical tone is sounded based on key-on information on the key.

Further, the CPU 24 generates an original tone signal corresponding to a pitch name associated with a touch position on the operated touch strip 6, based on a signal from the touch scan circuit 21, and outputs the generated original tone signal to the third tone generator circuit 29, whereby an arpeggio performance is carried out. As a tone generator circuit for arpeggio performance (hereinafter referred to as "the arpeggio performance tone generator circuit"), not only the third tone generator circuit 29 dedicated to arpeggio performance, but also the first or second tone generator circuit 27 or 28 is used in a switching fashion.

Figure 3A:
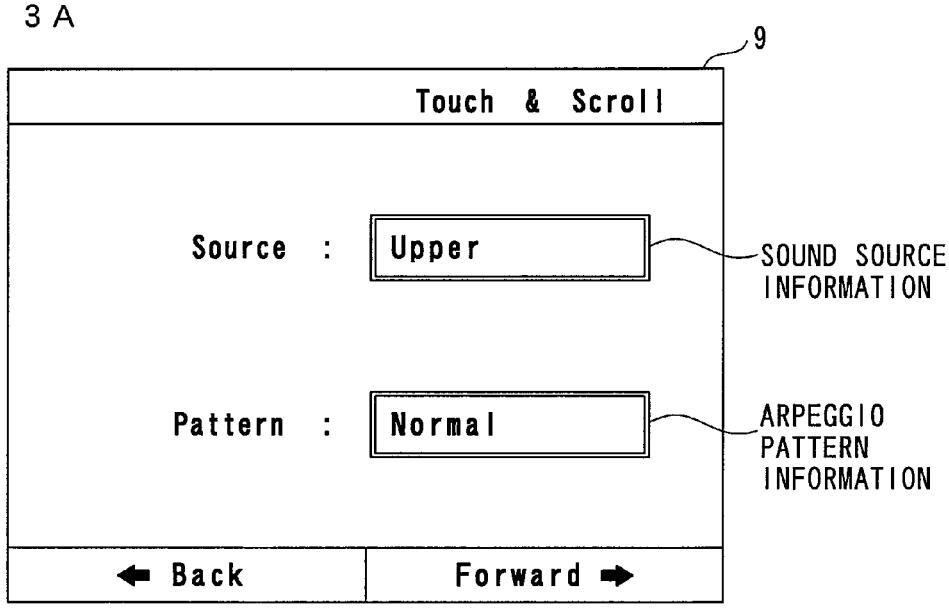
FIGS. 3A and 3B are views of a touch panel.
Figure 3B:
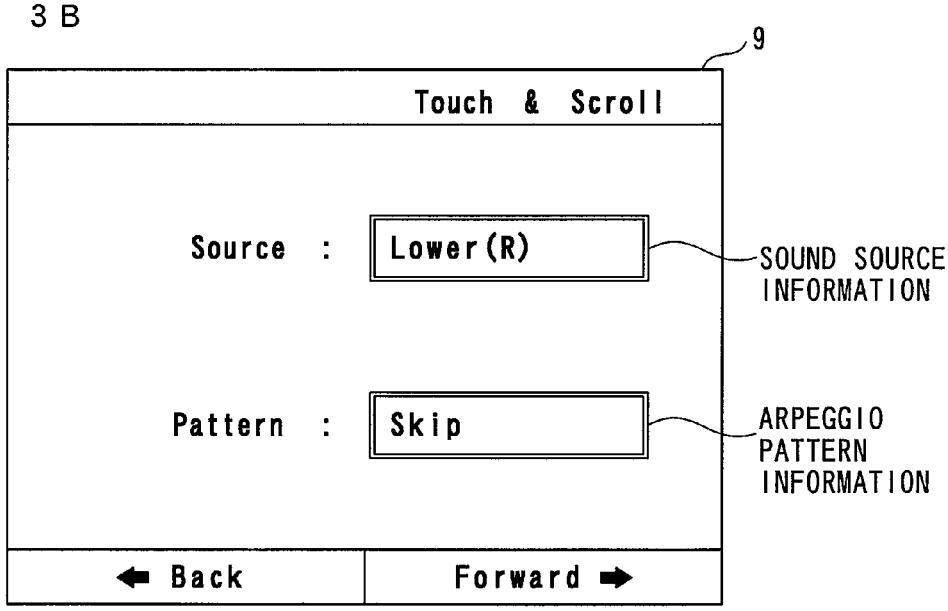

FIGS. 3A and 3B show a screen displayed on the display section 9 for switching of the arpeggio performance tone generator circuit and the arpeggio pattern. On this screen, sound source information is displayed in a "Source" field, and arpeggio pattern information is displayed in a "Pattern" field. "Upper" displayed in the "Source" field in FIG. 3A indicates that the first tone generator circuit 27 is selected as the arpeggio performance tone generator circuit. Further, "Lower (R)" displayed in the "Source" field in FIG. 3B indicates that the second tone generator circuit 28 is selected as the arpeggio performance tone generator circuit, and "Golden Harp" (not shown) indicates that the third tone generator circuit 29 is selected as the arpeggio performance tone generator circuit. When a sound source information item is selected and displayed by operating the display section 9, a sound source selection signal indicative of a selected tone generator circuit is output to the panel scan circuit 22. For example, when "Upper" is caused to be displayed, the first tone generator circuit 27 is selected as the arpeggio performance tone generator circuit, and a sound source selection signal indicative of the selection is output to the panel scan circuit 22. On the other hand, when "Lower (R)" is caused to be displayed, the second tone generator circuit 28 is selected as the arpeggio performance tone generator circuit, and a sound source selection signal indicative of the selection is output to the panel scan circuit 22, while when "Golden Harp" is caused to be displayed, the third tone generator circuit 29 is selected as the arpeggio performance tone generator circuit, and a sound source selection signal indicative of the selection is output to the panel scan circuit 22.

Further, "Normal" displayed in the "Pattern" field in FIG. 3A indicates that the arpeggio pattern is set to the normal pattern, and "Skip" displayed in the "Pattern" field in FIG. 3B indicates that the arpeggio pattern is set to the skip pattern. When "Normal" is displayed by operating the display section 9, the normal pattern is selected as the arpeggio pattern, and an arpeggio pattern signal indicative of the selection is output to the panel scan circuit 22. On the other hand, when "Skip" is displayed, the skip pattern is selected as the arpeggio pattern, and an arpeggio pattern signal indicative of the selection is output to the panel scan circuit 22.

Figure 6:
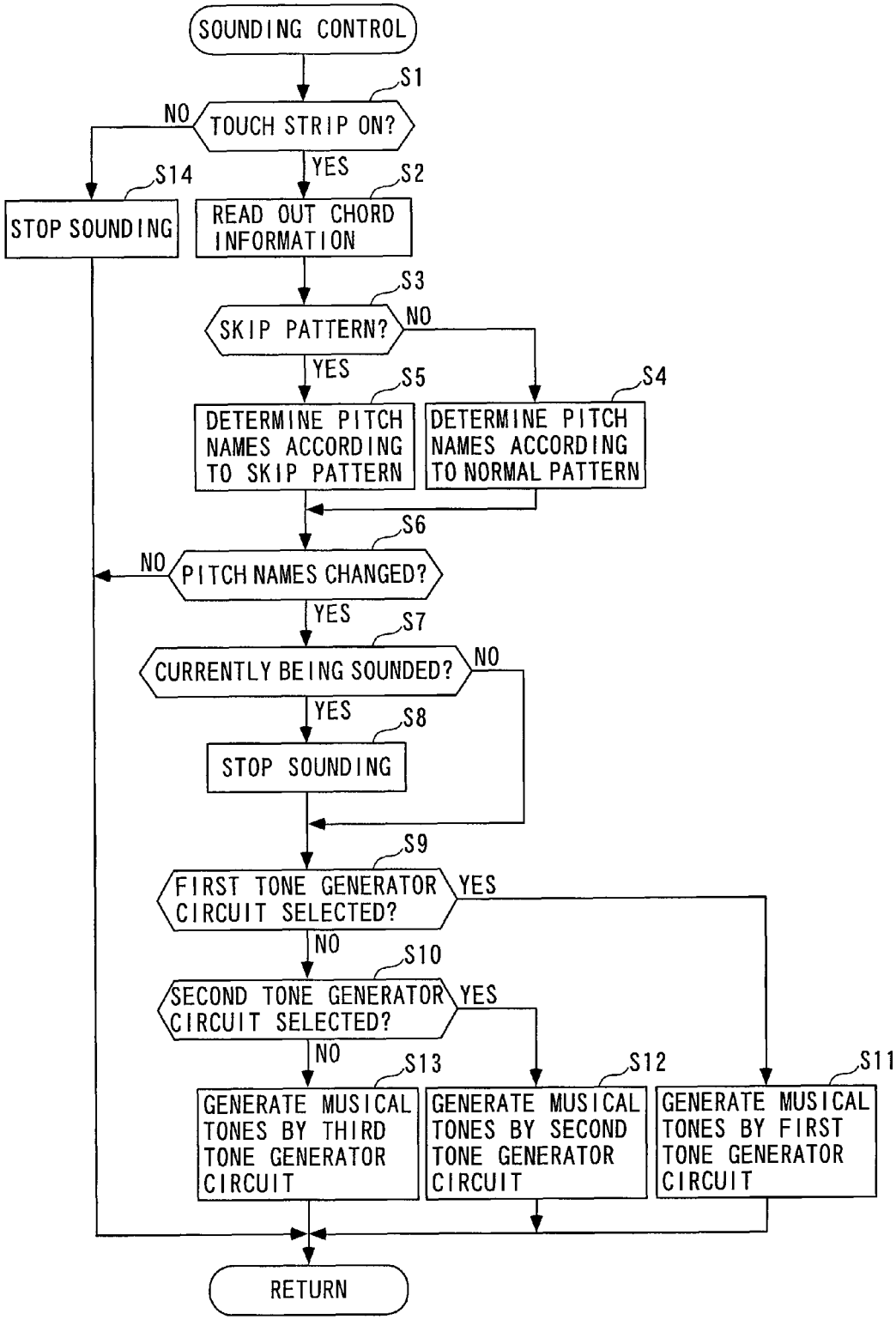
FIG. 6 is a flowchart of a sounding control process executed in response to an operation on the touch strip.

FIG. 6 is a flowchart of a sounding control process executed in an arpeggio performance. The present process is executed whenever a predetermined time period elapses. In the present process, first in a step 1 (shown as S1 in abbreviated form in FIG. 6; the following steps are also shown in abbreviated form), it is determined, based on touch information from the touch scan circuit 21, whether or not the touch strip 6 is currently operated (i.e. whether or not the touch strip 6 is on). If the answer to the question of the step 1 is affirmative (YES), latest chord information is read out from the RAM 26 (step 2), and then the process proceeds to a step 3.

FIG. 7 is a flowchart of an update process for updating the chord information. The present process is also executed whenever a predetermined time period elapses. In the present process, first in a step 21, a key-on chord is determined based on key-on information on at least three keys 3*a* depressed on the left lower keyboard 4. Next, it is determined whether or not the key-on chord has been changed (step 22). Specifically, when component pitch names forming the key-on chord determined this time is different from component pitch names determined last time, it is determined that the key-on chord has been changed. If the answer to the question of the step 22 is negative (NO), i.e. if the key-on chord has not been changed, the present process is immediately terminated. On the other hand, if the answer to the question is affirmative (YES), i.e. if the key-on chord has been changed, the component pitch names forming the present key-on chord and a component pitch name count indicative of the number of the component pitch names are stored as chord information in the RAM 26. Thus, whenever the key-on chord is changed, the chord information is updated.

Referring again to FIG. 6, in the step 3, it is determined, based on the arpeggio pattern signal from the panel scan circuit 22, whether or not the skip patter has been selected as the arpeggio pattern. If the answer to the question is negative (NO), i.e. if the normal pattern has been selected, the pitch names of respective musical tones are determined based on the normal pattern stored in the ROM 25 (step 4), and then the process proceeds to a step 6. Specifically, the number of the component pitch names forming the key-on chord is obtained from the chord information read out in the step 2, and a normal pattern map stored in the ROM 25 is searched based on the component pitch name count, the key-on chord, and voltage values from the touch strip 6, whereby the pitch names of the respective musical tones are determined.

On the other hand, if the answer to the question of the step 3 is affirmative (YES), i.e. if the skip pattern has been selected, the pitch names of respective musical tones are determined based on the skip pattern by the same method as in the case of the normal pattern (step 5), and then the process proceeds to a step 6.

In the step 6, it is determined whether or not the pitch names determined in the step 4 or 5 this time have been changed from those determined last time. If the answer to the question is affirmative (YES), it is determined whether or not the musical tones are being sounded (step 7). If the answer to the question is negative (NO), the process directly proceeds to a step 9. On the other hand, if the answer to the question of the step 7 is affirmative (YES), i.e. if the musical tones are being sounded, output of the original tone signals to the first to third tone generator circuits 27 to 29 is stopped to stop sounding of the musical tones (step 8), and then the process proceeds to the step 9.

In the step 9, it is determined, based on the sound source selection signal from the panel scan circuit 22, whether or not the first tone generator circuit 27 has been selected. If the answer to the question is affirmative (YES), the original tone signals generated based on the pitch names determined in the step 4 or 5 are output to the first tone generator circuit 27 (step 11), followed by terminating the present process. This causes the musical tones of the respective determined pitch names to be sounded. This control process is repeatedly executed, whereby an arpeggio performance using musical tones generated by the first tone generator circuit 27 is realized.

If the answer to the question of the step 9 is negative (NO), it is determined whether or not the second tone generator circuit 28 has been selected (step 10). If the answer to the question is affirmative (YES), the original tone signals generated based on the pitch names determined in the step 4 or 5 are output to the second tone generator circuit 28 (step 12), followed by terminating the present process. This control process is repeatedly executed, whereby an arpeggio performance using musical tones generated by the second tone generator circuit 28 is realized.

If the answer to the question of the step 10 is negative (NO), i.e. if the third tone generator circuit 29 has been selected, the original tone signals generated based on the pitch names determined in the step 4 or 5 are output to the third tone generator circuit 29 (step 13), followed by terminating the present process. This control process is repeatedly executed, whereby an arpeggio performance using musical tones generated by the third tone generator circuit 28 is realized.

On the other hand, if the answer to the question of the step 6 is negative (NO), i.e. if the pitch names have not been changed, the present process is immediately terminated. As a consequence, musical tones sounded in the immediately preceding loop continue to be sounded without being changed.

Further, if the answer to the question of the step 1 is negative (NO), i.e. if the touch strip 6 is not currently operated, output of original tone signals to the first to third tone generator circuits 27 to 29 is stopped (step 14), followed by terminating the present process. Thus, when musical tones are being sounded, the sounding is stopped.

FIGS. 8A and 8B illustrate examples of operation in a case where the touch strip 6 is sequentially touched from a low-pitch side, with keys 3*a* on the left lower keyboard 4 depressed. In these examples, the key-on chord is "CM7". When the normal pattern is selected as the arpeggio pattern, it is determined that the key-on chord is CM7 (step 21 in FIG. 7), and the pitch names included in CM7 are determined based on the normal pattern map (see FIG. 10) (step 4 in FIG. 6).

Specifically, when it is determined that the key-on chord is CM7, since the number of the component pitch names forming the key-on chord is equal to 4, "4" is written into a component pitch name count buffer, as shown in FIGS. 9A and 9B, and pitch names "C", "E", "G", and "B" are assigned to respective buffer Nos. 0 to 3 of component pitch name buffers. In a map shown in FIG. 10, for one octave of a pitch name "C" to a pitch name "B", there are assigned respective touch position numbers 0 to 11. Further, component pitch name reference indexes each indicative of a buffer number for reference are set in association with the respective touch position numbers according to each component pitch name count. When the component pitch name count is equal to 4, one octave is divided into four, and touch position number groups 0 to 2, 3 to 5, 6 to 8, and 9 to 11 are set to component pitch name reference indexes 0 to 3, respectively. With this configuration, for example, as the touch strip 6 is operated from the pitch name "C" toward a higher-pitch side, pitch names associated with buffer numbers indicated by the component pitch name reference indexes corresponding to the detected touch position numbers are sequentially read out to cause musical tones to be sounded in the order of "C"→"E"→"C"→"B", whereby an arpeggio performance is carried out in the normal pattern as shown in FIG. 8A.

On the other hand, when the skip pattern is selected as the arpeggio pattern, touch position number groups 0 to 2, 3 to 5, 6 to 8, and 9 to 11 are set to component pitch name reference indexes 0, 2, 1, and 3 respectively. That is, the settings concerning the touch position number groups 3 to 5 and 6 to 8 are reverse to those in the normal pattern. As a consequence, as the touch strip 6 is operated from the pitch name "C" toward a higher-pitch side, pitch names associated with buffer Nos. 0, 2, 1, and 3 are sequentially read out in the mentioned order, to cause musical tones to be sounded in the order of "C"→"G"→"E"→"B", whereby an arpeggio performance is carried out in the skip pattern as shown in FIG. 8B.

Although in the above example, it is assumed that the component pitch name count is equal to 4, also in cases where the component pitch name count is not set to 4, pitch names forming a determined key-on chord are assigned to respective component pitch name buffers, and pitch names associated with component pitch name reference indexes set according to the number of the component pitch names are sequentially read out from the component pitch name buffers, whereby arpeggio performances in the normal pattern and the skip pattern can be carried out in the same manner.

When the component pitch name count is equal to 0, i.e. when no key is currently depressed on the left lower keyboard 4, "0" is written into the component pitch name count buffer, and pitch names "C", "C#", . . . "A#", and "B" are assigned to respective buffer Nos. 0 to 11 of component pitch name buffers. Further, touch position numbers/number groups 0 and 1, 2, 3 and 4, 5, 6 and 7, 8 and 9, and 10 and 11 are set to component pitch name reference indexes 0, 2, 4, 5, 7, 9, and 11, respectively. As a consequence, as the touch strip 6 is operated from the pitch name "C" toward a higher-pitch side, pitch names associated with the buffer Nos. 0, 2, 4, 5, 7, 9, and 11 are sequentially read out in the mentioned order, to cause musical tones to be sounded in the order of "C"→"D"→"E"→"F"→"G"→"A"→"B". Thus, when the touch strip 6 is operated with no key depressed on the left lower keyboard 4, only musical tones associated with respective white keys are sounded.

Figure 10:
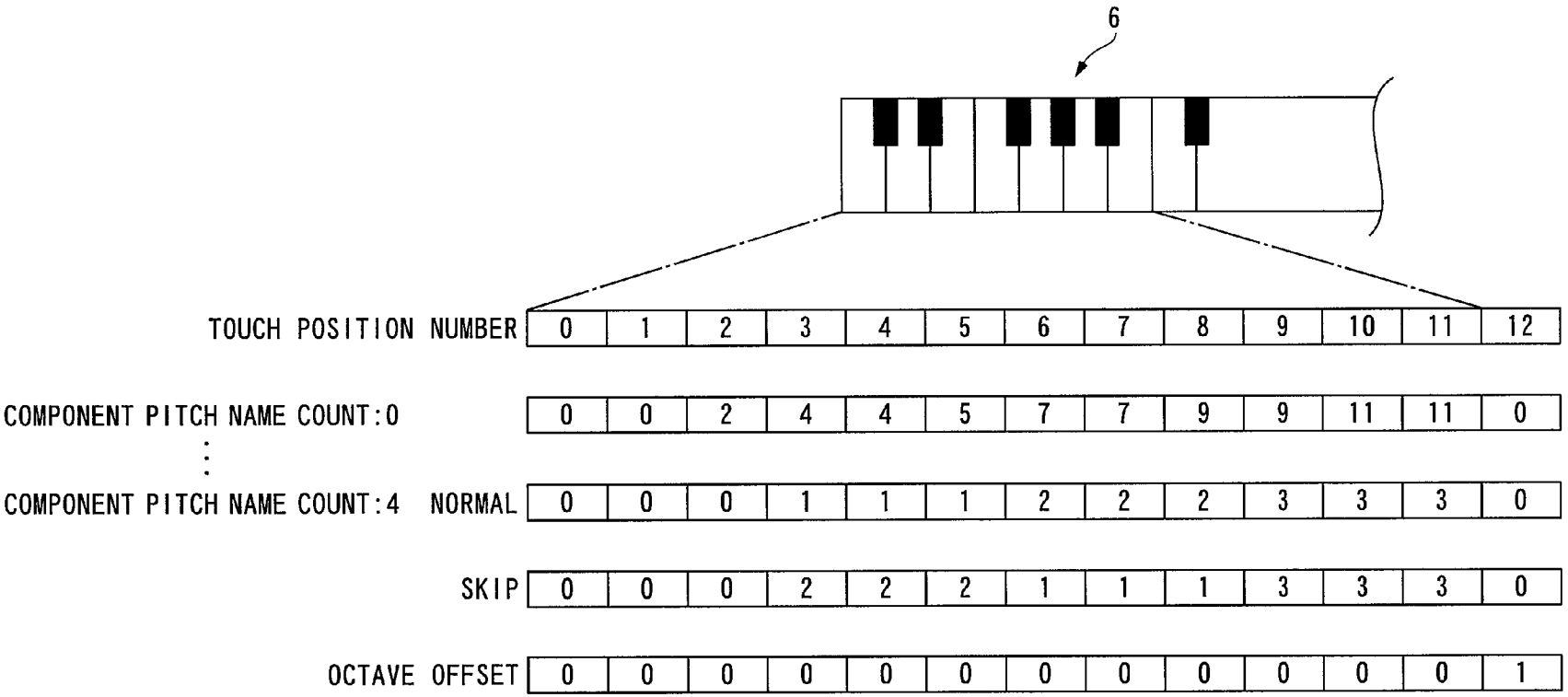
FIG. 10 is a diagram of examples of arpeggio pattern maps.

Further, in a map in FIG. 10, an offset value for octave offset for determining pitches of respective musical tones is set in association with each of the touch position numbers. The offset value is set to 0 in association with the touch position numbers 0 to 11, i.e. in a first octave of the pitch names "C" to "B", to 1 in a second octave of the same, and to 2 in a third octave of the same. When the octave value is equal to 0, predetermined pitches are set on a pitch name-by-pitch name basis, and when the octave value is equal to 1, pitches are set on a pitch name-by-pitch name basis such that each of the pitches becomes one octave higher than an associated one of the predetermined pitches. With this configuration, as the touch strip 6 is operated for more than one octave toward a higher-pitch side, the pitches of respective sounded tones become one octave higher each time the offset value is incremented by 1, whereby an arpeggio performance with a pitch range of more than one octave can be realized.

As described above, according to the present embodiment, the arpeggio performance tone generator circuit is switched between the third tone generator circuit 29 dedicated to arpeggio performance and the first or second tone generator circuit 27 or 28 originally for use in generation of musical tones on the upper keyboard 2 or the lower keyboard 3. Therefore, when the arpeggio performance tone generator circuit is switched to the first or second tone generator circuit 27 or 28, it is possible to sound musical tones having the monophonic effect, the harmony effect, or the grace note effect added thereto. By thus utilizing the existing first or second tone generator circuit 27 or 28 for keys 2*a* or 3*a* for an arpeggio performance by the touch string 6, an arpeggio performance rich in variety can be realized.

Further, since the arpeggio patterns include not only the normal pattern, but also the skip pattern, it is possible to carry out an arpeggio performance rich in variety.

It should be noted that the present invention is by no means limited to the embodiment described above, but it can be practiced in various forms. For example, although in the embodiment, both the first tone generator circuit 27 for the upper keyboard 2 and the second tone generator circuit 28 for the lower keyboard 3 are used as the arpeggio performance tone generator circuits in addition to the third tone generator circuit 29, only one of the first and second tone generator circuits 27 and 28 may be used. Further, although in the embodiment, only one skip pattern is stored in association with a chord, more than two skip patterns may be stored.

What is more, although in the embodiment, determination as to a key-on chord on the left lower keyboard 4 is performed when at least three keys 3*a* are depressed, this is not limitative, but a key-on chord on the left lower keyboard 4 may be determined e.g. when one or two keys are depressed. Alternatively, without performing such determination as to a key-on chord on the left lower keyboard 4, arpeggio performance may be carried out by using the pitch names associated with a plurality of keys 3*a* depressed on the left lower keyboard 4, as component pitch names. In this case, Furthermore, although in the embodiment, the touch strip 6 is formed by a piezoelectric sheet, this is not limitative, but the touch strip 6 may be formed by elements, such as switches, which generate respective voltages by being touched, such that the voltages differ from each other according to the respective touch positions.

Furthermore, the electronic keyboard instrument according to the present embodiment may an electronic keyboard instrument, e.g. an electronic piano or keyboard, other than the electronic organ.

It is further understood by those skilled in the art that the foregoing are preferred embodiments of the invention, and that various changes and modifications may be made without departing from the spirit and scope thereof.

What is claimed is:

1. An electronic keyboard instrument comprising:

a touch strip in the form of a belt on which a keyboard having a plurality of keys arranged in a left-right direction thereof is displayed and a player slides a player's finger while touching said touch strip, so as to carry out an arpeggio performance;

touch position-detecting means for detecting touch positions on said touch strip at which the player's finger touches said touch strip;

component pitch name-designating means for designating a plurality of component pitch names to be sounded in the arpeggio performance;

arpeggio performance means for sounding musical tones of respective pitch names included in the respective designated component pitch names, in a predetermined arpeggio pattern having a predetermined sounding order, according to the touch positions detected when the player slides his/her finger on said touch strip while touching said touch strip, to thereby carry out the arpeggio performance using the component pitch names;

a first musical tone-generating circuit dedicated to generation of musical tones for the arpeggio performance;

a plurality of swingable keys;

key-on information-detecting means for detecting key-on information on each of the keys;

a second musical tone-generating circuit for generating musical tones based on the key-on information detected by said key-on information-detecting means; and switching means for switching a musical tone generating circuit for use in generation of musical tones for the arpeggio performance between said first musical tone-generating circuit and said second musical tone-generating circuit.

2. An electronic keyboard instrument as claimed in claim 1, further comprising:

arpeggio pattern storage means for storing, as the predetermined arpeggio pattern, a plurality of arpeggio patterns having respective sounding orders different from each other, and including at least one skip pattern; and arpeggio pattern-selecting means for selecting one arpeggio pattern from the stored arpeggio patterns.

* * * * *